US011999583B2

(12) United States Patent
Aoki et al.

(10) Patent No.: US 11,999,583 B2
(45) Date of Patent: Jun. 4, 2024

(54) SHEET CONVEYANCE APPARATUS

(71) Applicant: Horizon International Inc., Takashima (JP)

(72) Inventors: Eiji Aoki, Takashima (JP); Tomonori Yachi, Takashima (JP); Hiromasa Nambu, Takashima (JP)

(73) Assignee: HORIZON INTERNATIONAL INC., Shiga (JP)

( * ) Notice: Subject to any disclaimer, the term of this patent is extended or adjusted under 35 U.S.C. 154(b) by 0 days.

(21) Appl. No.: 17/766,974

(22) PCT Filed: Jul. 22, 2020

(86) PCT No.: PCT/JP2020/028475
§ 371 (c)(1),
(2) Date: Apr. 6, 2022

(87) PCT Pub. No.: WO2021/070450
PCT Pub. Date: Apr. 15, 2021

(65) Prior Publication Data

US 2024/0076152 A1 Mar. 7, 2024

(30) Foreign Application Priority Data

Oct. 8, 2019 (JP) ..... 2019-185322

(51) Int. Cl.
*B65H 3/12* (2006.01)
*B65H 5/22* (2006.01)
*B65H 31/02* (2006.01)

(52) U.S. Cl.
CPC ..... *B65H 3/126* (2013.01); *B65H 3/124* (2013.01); *B65H 5/224* (2013.01); *B65H 31/02* (2013.01);
(Continued)

(58) Field of Classification Search
CPC ..... B65H 1/06; B65H 3/042; B65H 3/126; B65H 3/34; B65H 31/02; B65H 2406/31;
(Continued)

(56) References Cited

U.S. PATENT DOCUMENTS 4,219,191 A * 8/1980 Rastorguyeff ..... B65H 3/46 271/94
5,181,706 A 1/1993 Yamamoto et al.
(Continued)

FOREIGN PATENT DOCUMENTS

CA 2039487 A1 10/1991
CN 105173797 A 12/2015
(Continued)

*Primary Examiner* — Prasad V Gokhale
(74) *Attorney, Agent, or Firm* — Muncy, Geissler, Olds & Lowe, P.C>

(57) ABSTRACT

An endless conveyer belt is stretched between drive and idle rollers. A carriage is arranged so as to reciprocate along the endless conveyer belt. A suction box is arranged between upper and lower belt portions of the endless conveyer belt and fixed to the carriage. A stopper plate is fixed to the carriage and extends across a conveyer surface and upward from the conveyer surface. A conveyance roller pair is arranged at the upstream end of the conveyer surface. A region of the conveyer surface from a stopper plate to the upstream end u forms a sheet accumulation area. A cover sheet covers a region upstream of the suction box in the sheet accumulation area. The cover sheet is subjected to tension in the longitudinal direction by a winding-type constant force plate spring and continually tensed spaced apart from the endless conveyer belt.

6 Claims, 5 Drawing Sheets

(52) U.S. Cl.
CPC ..... *B65H 2301/44735* (2013.01); *B65H 2301/4474* (2013.01); *B65H 2402/32* (2013.01); *B65H 2406/3124* (2013.01)

(58) Field of Classification Search
CPC ..... B65H 2406/3124; B65H 2408/21; B65H 2408/215
See application file for complete search history.

(56) References Cited

U.S. PATENT DOCUMENTS

| | | | | |
|---|---|---|---|---|
| 5,836,582 | A | 11/1998 | Ogawa et al. | |
| 5,954,325 | A * | 9/1999 | Nagao ..... | B65H 3/56 271/200 |
| 2012/0292895 | A1 | 11/2012 | Schutz | |
| 2013/0292895 | A1 | 11/2013 | Ito | |

FOREIGN PATENT DOCUMENTS

| | | | |
|---|---|---|---|
| CN | 109110527 | A | 1/2019 |
| EP | 0 035 428 | A1 | 9/1981 |
| JP | S 57-72532 | A | 5/1982 |
| JP | H 03-272931 | A | 12/1991 |
| JP | H 04-105039 | U | 9/1992 |
| JP | H 08-40582 | A | 2/1996 |
| JP | 2001-019261 | A | 1/2001 |
| JP | 2012-158420 | A | 8/2012 |
| JP | 2018-002368 | A | 1/2018 |

* cited by examiner

FIG. 4A
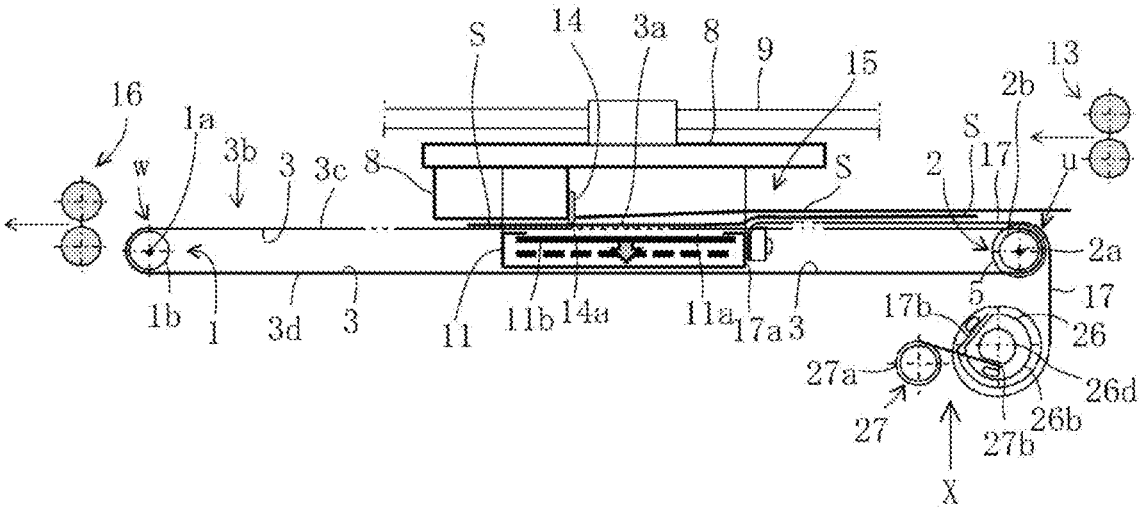
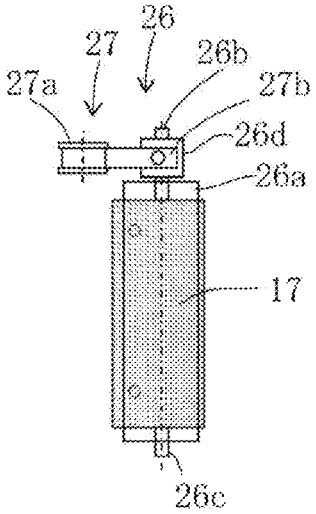
FIG. 4B

SHEET CONVEYANCE APPARATUS

TECHNICAL FIELD

The present invention relates to a sheet conveyance apparatus that conveys a sheet discharged from one sheet processing apparatus to another sheet processing apparatus, in particular, to a sheet conveyance apparatus having a function of temporarily accumulating sheets in the middle of conveyance.

BACKGROUND ART

In a book binding process, two separate sheet processing apparatuses are connected to each other via a sheet conveyance apparatus, a sheet discharged from one of the sheet processing apparatuses is fed to the other sheet processing apparatus by the sheet conveyance apparatus, and this provides automated operation and increased productivity.

In such a case, the sheet conveyance apparatus needs to feed sheets, which have been sequentially discharged from the upstream sheet processing apparatus, to the downstream sheet processing apparatus in accordance with a processing timing of the downstream sheet processing apparatus.

In general, the processing speed of the upstream sheet processing apparatus and the processing speed of the downstream sheet processing apparatus are not the same. Thus, for example, when the upstream sheet processing apparatus has a faster processing speed than the downstream sheet processing apparatus, it is required to temporarily accumulate and store sheets in the middle of conveyance of the sheet conveyance apparatus and then convey the accumulated sheets to the downstream in accordance with the processing timing of the downstream sheet processing apparatus.

In the conventional art, however, although there is a sheet conveyance apparatus that temporarily accumulates sheets discharged one by one from the upstream sheet processing apparatus (a printing apparatus or the like) in the middle of conveyance and, every time sheets for one volume are accumulated, conveys the sheet bundle for one volume to the downstream sheet processing apparatus (book binder) (for example, see Patent Literature 1), there has been no sheet conveyance apparatus that temporarily accumulates sheets in the middle of conveyance and can convey the accumulated sheets one by one to the downstream.

CITATION LIST

Patent Literature

[PTL 1]
Japanese Patent Application Laid-Open No. 2001-19261

SUMMARY OF INVENTION

Technical Problem

Accordingly, an object of the present invention is to provide a sheet conveyance apparatus that may temporarily accumulate sheets in the middle of conveyance and then convey the accumulated sheets one by one to the downstream.

Solution to Problem

To achieve the above object, according to the present invention, provided is a sheet conveyance apparatus including: a drive roller and an idle roller extending both horizontally and parallel to each other; at least one endless conveyer belt stretched between the drive roller and the idle roller; a first drive mechanism configured to rotate the drive roller; a carriage arranged so as to reciprocate in a longitudinal direction of the endless conveyer belt above the at least one endless conveyer belt; at least one slide guide extending in the longitudinal direction of the endless conveyer belt, the carriage being slidably attached to the at least one slide guide, a second drive mechanism being configured to slide the carriage; a suction box arranged so as to reciprocate in the longitudinal direction of the endless conveyer belt between upper and lower belt portions of the at least one endless conveyer belt; and an intake source configured to generate a negative pressure inside the suction box, wherein the suction box is attached to the carriage and has at least one intake hole in a surface facing the upper belt portion, wherein a plurality of airflow holes are provided in the longitudinal direction of the at least one endless conveyer belt at positions of the at least one endless conveyer belt that pass by the at least one intake hole during rotation of the at least one endless conveyer belt, and the sheet conveyance apparatus further including: at least one conveyance roller pair extending above an upstream end of a conveyer surface of the at least one endless conveyer belt and across the conveyer surface and configured to take in a sheet and feed out the sheet onto the conveyer surface; and a stopper plate attached to the carriage and extending across the conveyer surface and upward from the conveyer surface, wherein a lower end of the stopper plate faces the suction box and is arranged with a predetermined spacing from the conveyer surface, and a region in the conveyer surface from the stopper plate to the upstream end of the conveyer surface forms a sheet accumulation area, and wherein sheets fed out from the at least one conveyance roller pair are sequentially accumulated in the sheet accumulation area when each front end of the sheets collides with the stopper plate, and the lowermost sheet of accumulated sheets is separated one by one from remaining sheets by the suction box and conveyed toward a downstream end of the conveyer surface through the spacing between the conveyer surface and the stopper plate by the at least one endless conveyer belt.

According to a preferred embodiment of the present invention, the sheet conveyance apparatus further includes a mechanism to prevent contact between the accumulated lowermost sheet and the conveyer surface of the at least one endless conveyer belt in a region upstream of the upstream end of the suction box in the sheet accumulation area.

According to another preferred embodiment of the present invention, the mechanism to prevent contact has a cover sheet that covers a region upstream of the suction box in the sheet accumulation area, the cover sheet has a width corresponding to a width of the sheet accumulation area and a length equal to or larger than a length from the upstream end of the suction box to an upstream end of the sheet accumulation area when a length of the sheet accumulation area is the largest, and one end of the cover sheet is fixed to the upstream end of the suction box and extends across the sheet accumulation area, and wherein the mechanism to prevent contact further has a tensioner attached to the other end of the cover sheet and configured to continually apply tension in a longitudinal direction of the cover sheet, and the cover sheet is tensed in a state where a portion of the cover sheet covering the at least one endless conveyer belt is continually spaced apart from the at least one endless conveyer belt.

According to yet another preferred embodiment of the present invention, the at least one endless conveyer belt includes a plurality of endless conveyer belts spaced apart from each other in the width direction, wherein the drive roller has a horizontal rotary shaft, and a plurality of first roller elements axially spaced apart from each other and attached to the rotary shaft integrally with and rotatably about the rotary shaft, wherein the idle roller has a plurality of second roller elements arranged so as to be rotatable about a parallel shaft parallel to the rotary shaft of the drive roller and face the plurality of first roller elements, respectively, and each of the plurality of endless conveyer belts is stretched between the first and second roller elements paired with each other, and the rotary shaft of the drive roller is rotated by the first drive mechanism, wherein the mechanism to prevent contact further has, between the first roller elements adjacent to each other or the second roller elements adjacent to each other of a roller that is one of the drive roller and the idle roller which is located at the upstream end of the conveyer surface and outside the outermost one of the first or second roller elements, a plurality of third roller elements each provided coaxially with the first or second roller elements and rotatably independently of the rotary shaft or rotatably about the parallel shaft, and each of the third roller elements has a larger diameter than each of the first or second roller elements of interest, and wherein the tensioner includes at least one winding-type constant force plate spring arranged at a fixed position under the at least one endless conveyer belt, and the other end of the cover sheet extends to the at least one winding-type constant force plate spring via a part of circumferential surfaces of the third roller elements and is attached to an end of the at least one winding-type constant force plate spring.

According to yet another preferred embodiment of the present invention, the at least one endless conveyer belt includes a plurality of endless conveyer belts spaced apart from each other in the width direction, wherein the drive roller has a horizontal rotary shaft, and a plurality of first roller elements axially spaced apart from each other and attached to the rotary shaft integrally with and rotatably about the rotary shaft, wherein the idle roller has a plurality of second roller elements arranged so as to be rotatable about a parallel shaft parallel to the rotary shaft of the drive roller and face the plurality of first roller elements, respectively, and each of the plurality of endless conveyer belts is stretched between the first and second roller elements paired with each other, and the rotary shaft of the drive roller is rotated by the first drive mechanism, wherein the mechanism to prevent contact further has, between the first roller elements adjacent to each other or the second roller elements adjacent to each other of a roller that is one of the drive roller and the idle roller which is located at the upstream end of the conveyer surface and outside the outermost one of the first or second roller elements, a plurality of third roller elements each provided coaxially with the first or second roller elements and rotatably independently of the rotary shaft or rotatably about the parallel shaft, and each of the third roller elements has a larger diameter than each of the first or second roller elements of interest, wherein the tensioner has a cover sheet winding roller arranged under and parallel to a roller that is one of the drive roller and the idle roller which has the third roller elements, and the other end of the cover sheet extends to the cover sheet winding roller via a part of circumferential surfaces of the third roller elements and is fixed to a circumferential surface of the cover sheet winding roller, and wherein the tensioner further has at least one winding-type constant force plate spring arranged at a fixed position under the at least one endless conveyer belt, the fixed position is on the opposite side from the third roller elements with respect to the cover sheet winding roller and on at least one end side of the cover sheet winding roller, an end of the winding-type constant force plate spring is attached to a rotary shaft of the cover sheet winding roller, and the winding-type constant force plate spring continually applies force to the cover sheet winding roller in a winding direction of the cover sheet.

According to yet another preferred embodiment of the present invention, the at least one endless conveyer belt includes a plurality of endless conveyer belts spaced apart from each other in the width direction, wherein the drive roller has a horizontal rotary shaft, and a plurality of first roller elements axially spaced apart from each other and attached to the rotary shaft integrally with and rotatably about the rotary shaft, wherein the idle roller has a plurality of second roller elements arranged so as to be rotatable about a parallel shaft parallel to the rotary shaft and face the plurality of first roller elements, and each of the plurality of endless conveyer belts is stretched between the first and second roller elements paired with each other, and the rotary shaft of the drive roller is rotated by the first drive mechanism, wherein the mechanism to prevent contact has, between the first roller elements adjacent to each other or the second roller elements adjacent to each other of a roller that is one of the drive roller and the idle roller which is located at the upstream end of the conveyer surface and outside the outermost one of the first or second roller elements, a plurality of third roller elements each provided coaxially with the first or second roller elements and rotatably independently of the rotary shaft or rotatably about the parallel shaft, and each of the third roller elements has a larger diameter than each of the first or second roller elements of interest, wherein the mechanism to prevent contact further has, between the first roller elements adjacent to each other or the second roller elements adjacent to each other of a roller that is one of the drive roller and the idle roller which is located at the downstream end of the conveyer surface and outside the outermost one of the first or second roller elements, a plurality of fourth roller elements each provided coaxially with the first or second roller elements and rotatably independently of the rotary shaft or rotatably about the parallel shaft, and each of the fourth roller elements has a smaller diameter than each of the first or second roller elements of interest, and wherein the mechanism to prevent contact further has an additional endless belt stretched between the third and fourth roller elements paired with each other and extending parallel to the plurality of endless conveyer belts, and an upper surface of the additional endless belt has a smaller friction factor than respective conveyer surfaces of the plurality of endless conveyer belts, and the upper surface of the additional endless belt is at a higher position than the conveyer surfaces of the plurality of endless conveyer belts in a region upstream of the suction box in the sheet accumulation area and is at a lower position than the conveyer surfaces of the plurality of endless conveyer belts in a region overlapping the suction box in the sheet accumulation area and a region downstream of the sheet accumulation area on the conveyer surfaces.

Advantageous Effects of Invention

According to the present invention, even when the processing speed of the upstream sheet processing apparatus is faster than the processing speed of the downstream sheet processing apparatus, it is possible to facilitate smooth handover of sheets between the upstream and downstream sheet processing apparatuses by temporarily accumulating sheets, which have been sequentially discharged from the upstream sheet processing apparatus, in a sheet accumulation area and feeding the lowermost sheet of the accumulated sheets one by one from the sheet accumulation area to the downstream sheet processing apparatus at a timing in accordance with the processing speed of the downstream sheet processing apparatus.

In addition, even when the length (the length in the conveyance direction) of a sheet to be processed in the upstream and downstream sheet processing apparatuses is changed, it is possible to address the change in the sheet size easily and quickly by changing the position of a carriage, that is, of a suction box and a stopper plate in accordance with the length of the sheet to adjust the length of the sheet accumulation area.

BRIEF DESCRIPTION OF DRAWINGS

FIG. 1 represents schematic diagrams of a sheet conveyance apparatus according to one embodiment of the present invention.

FIG. 2 represents front views illustrating motion of a carriage of the sheet conveyance apparatus of FIG. 1.

FIG. 4(A) is a front view of the sheet conveyance apparatus of FIG. 3, and FIG. 4(B) is a plan view of a tensioner of the sheet conveyance apparatus of FIG. 4(A) when viewed in the X direction.

FIG. 5 represents schematic diagrams of a sheet conveyance apparatus according to another embodiment of the present invention.

DESCRIPTION OF EMBODIMENTS

The configuration of the present invention will be described below based on preferred embodiments with reference to the attached drawings.

Figure 1A:
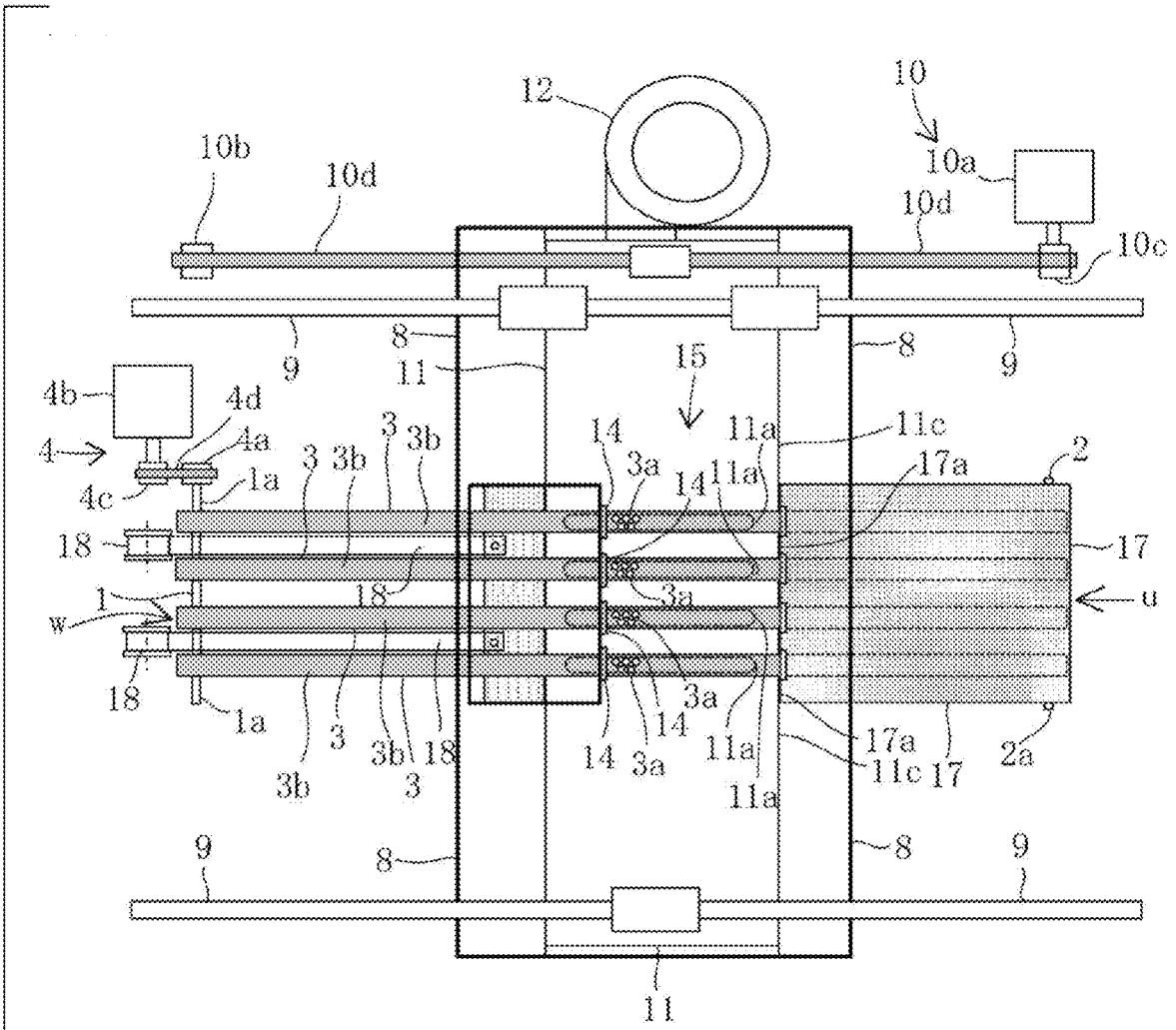
FIG. 1(A) is a plan view.
Figure 1B:
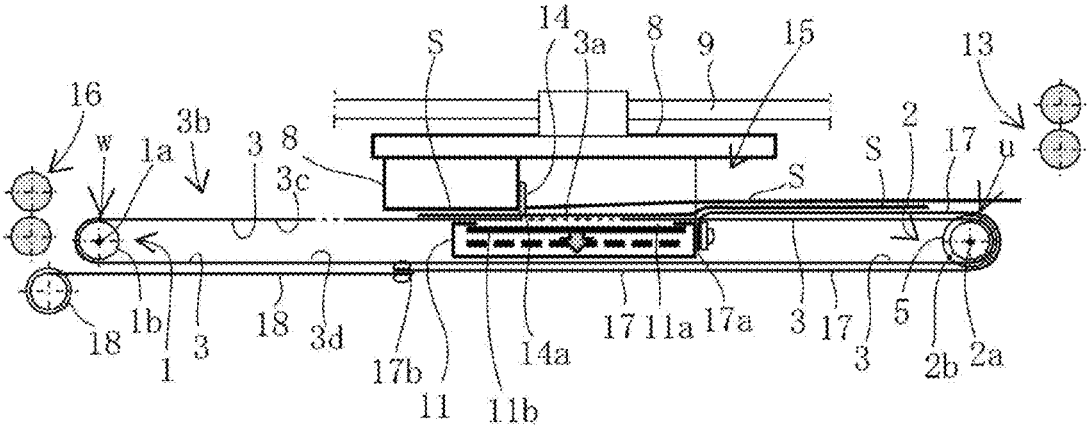
FIG. 1(B) is a front view.
Figures 2A, 2B:
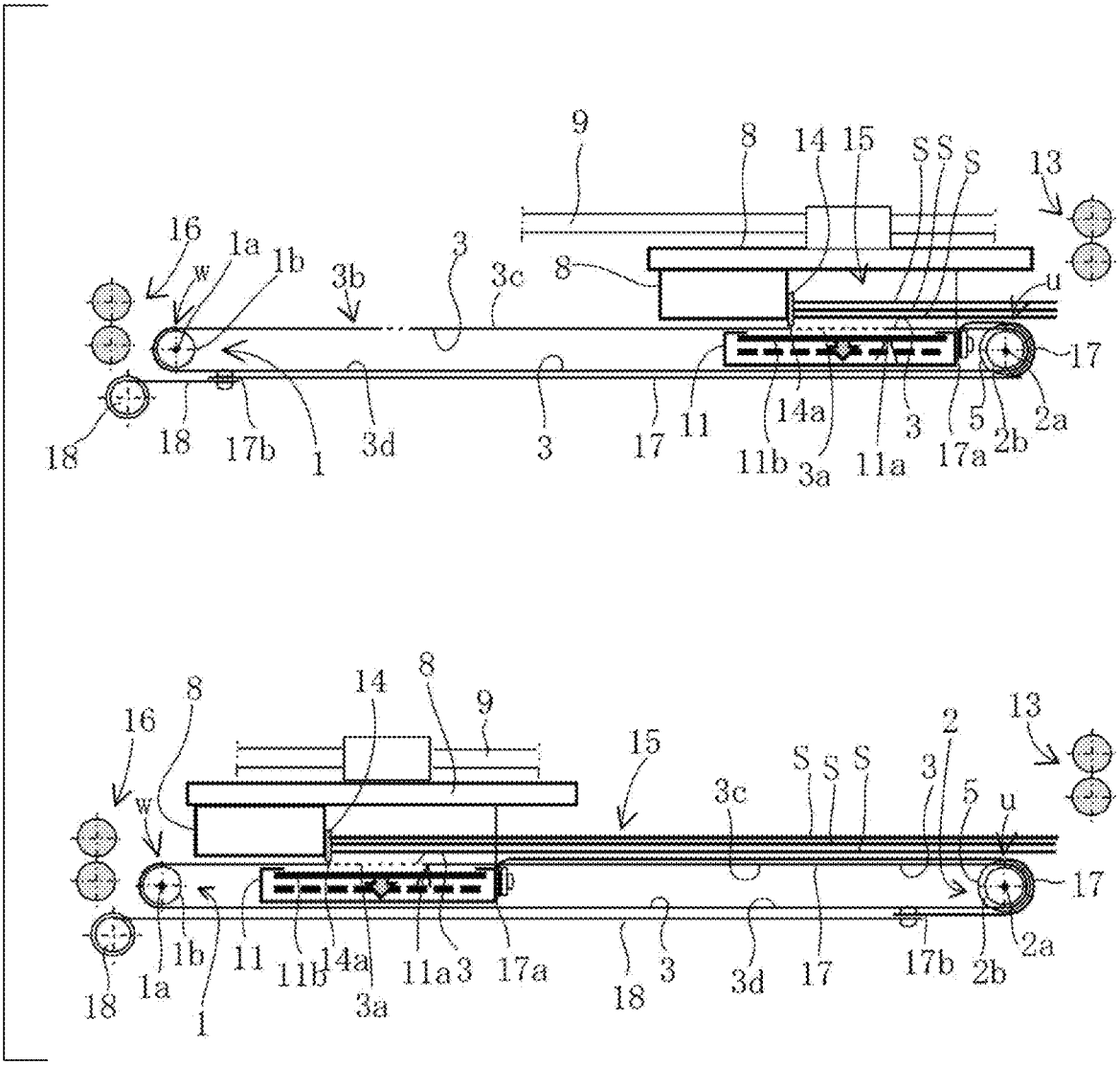
FIG. 2(A) illustrates a state where the carriage is at a position at which the length of the sheet accumulation area is the shortest.
FIG. 2(B) illustrates a state where the carriage is at a position at which the length of the sheet accumulation area is the longest.

FIG. 1 represents schematic diagrams of a sheet conveyance apparatus according to one embodiment of the present invention, FIG. 1(A) is a plan view, and FIG. 1(B) is a front view. FIG. 2 represents front views illustrating motion of a carriage of the sheet conveyance apparatus of FIG. 1, FIG. 2(A) illustrates a state where the carriage is at a position at which the length of the sheet accumulation area is the shortest, and FIG. 2(B) illustrates a state where the carriage is at a position at which the length of the sheet accumulation area is the longest.

With reference to FIG. 1, according to the present invention, there are provided a drive roller 1 and an idle roller 2 both extending horizontally and parallel to each other, at least one (four in this embodiment) endless conveyer belt 3 stretched between the drive roller 1 and the idle roller 2, and a first drive mechanism 4 that rotates the drive roller 1.

The drive roller 1 has a horizontal rotary shaft 1*a* and four first pulleys (roller elements) 1*b* spaced apart from each other in the axis direction and attached to the rotary shaft 1*a* integrally with and rotatably about the rotary shaft 1*a*.

The idle roller 2 has four second pulleys 2*b* (roller elements) arranged so as to be rotatable about a shaft 2*a* parallel to the rotary shaft 1*a* of the drive roller 1 and face the four first pulleys 1*b*, respectively.

Further, each endless conveyer belt 3 is stretched between the first pulley 1*b* of the drive roller 1 and the second pulley 2*b* of the idle roller 2 that are paired with each other. Each endless conveyer belt 3 has airflow holes 3*a* evenly over the entire length thereof.

The first drive mechanism 4 has a pulley 4*a* fixed to one end of the rotary shaft 1*a* of the drive roller 1, a motor 4*b* whose drive shaft extends parallel to the drive roller 1, a pulley 4*c* fixed to the drive shaft of the motor 4*b*, and an endless belt 4*d* stretched between the pulley 4*a* and the pulley 4*c*.

Further, during operation of the sheet conveyance apparatus, the four endless conveyer belts 3 simultaneously are rotated at a constant speed in response to the drive roller 1 being driven and rotated by the motor 4*b*, and the sheet S placed on the conveyer surfaces 3*b* of the four endless conveyer belts 3 is conveyed from the idle roller 2 side (the upstream end u of the conveyer surface 3*b*) to the drive roller 1 side (the downstream end w of the conveyer surface 3*b*).

According to the present invention, there are further provided a carriage 8 arranged above the endless conveyer belts 3 so as to be able to reciprocate in the longitudinal direction of the endless conveyer belt 3, at least one (two in this embodiment) slide guide 9 that extends in the longitudinal direction of the endless conveyer belt 3 and to which the carriage 8 is slidably attached, and a second drive mechanism 10 that causes the carriage 8 to slide.

The second drive mechanism 10 has a motor 10*a* and a pulley 10*b* spaced apart from each other in the longitudinal direction of the slide guide 9. The drive shaft of the motor 10*a* and the rotary shaft of the pulley 10*b* extend parallel to the drive roller 1 and the idle roller 2.

Further, a pulley 10*c* is fixed to the drive shaft of the motor 10*a*, and an endless belt 10*d* is stretched between the pulley 10*c* and the pulley 10*b* and extends parallel to the slide guide 9. The carriage 8 is fixed to the endless belt 10*d*.

Further, when the endless belt 10*d* is rotated forward and backward by the motor 10*a*, the carriage 8 may slide and reciprocate along the slide guide 9.

According to the present invention, there are further provided a suction box 11 arranged between the upper and lower belt portions 3*c* and 3*d* of the four endless conveyer belts 3 so as to be able to reciprocate in the longitudinal direction of the endless conveyer belt 3 and a suction fan (intake source) 12 directly coupled to the suction box 11 and configured to generate a negative pressure inside the suction box 11.

The suction box 11 is attached to the carriage 8. Further, the suction box 11 has intake holes 11*a* at positions in the upper surface above which respective endless conveyer belts 3 (the upper belt portions 3*c*) pass by and includes a shutter 11*b* therein that opens and closes the intake holes 11*a*.

Further, during operation of the sheet conveyance apparatus, while the suction fan 12 is continuously operated, the shutter 11*b* is opened and closed at constant timings, and thereby suction through the intake holes 11*a* is performed at the constant timings.

Further, according to the present invention, at least one (one in this embodiment) conveyance roller pair 13 extending across the conveyer surfaces 3*b* above the upstream end u of the conveyer surfaces 3*b* of the endless conveyer belts 3 and configured to take in the sheet S and feed out the sheet S onto the conveyer surfaces 3*b* and stopper plates 14 attached to the carriage 8 and extending across the conveyer surfaces 3*b* and upward from the conveyer surfaces 3*b*.

In this embodiment, the stopper plates 14 are separated into four parts in the longitudinal direction thereof, and each part of the stopper plates 14 corresponds to each endless conveyer belt 3.

Note that the stopper plates 14 may be formed of a single stopper plate extending across the entire conveyer surfaces 3*b* of the four endless conveyer belts 3.

The lower end 14*a* of the stopper plate 14 faces the suction box 11 and is arranged with a predetermined spacing from the conveyer surface 3*b*, and a region from the stopper plate 14 to the upstream end u of the conveyer surface 3*b* in the conveyer surface 3*b* forms a sheet accumulation area 15.

It is possible to change the length of the sheet accumulation area 15 within a range between the minimum length (see FIG. 2(A)) and the maximum length (see FIG. 2(B)) by changing the position of the carriage 8, that is, of the stopper plate 14 and the suction box 11.

Further, the conveyance roller pair 16 is arranged at the downstream end w of the conveyer surfaces 3*b* and extends across the conveyer surfaces 3*b*. The conveyance roller pair 16 receives the sheet S from the downstream end w of the conveyer surfaces 3*b* and discharges the received sheet S to outside of the sheet conveyance apparatus.

In the configuration described above, a discharge port of the upstream sheet processing apparatus is connected to the inlet side of the conveyance roller pair 13, and a feed port of the downstream sheet processing apparatus is connected to the outlet side of the conveyance roller pair 16.

Further, before starting an operation of the sheet conveyance apparatus, the position of the carriage 8, that is, of the stopper plate 14 and the suction box 11 is adjusted in accordance with the length of the sheet S to be conveyed (the length in the conveyance direction), and thereby the length of the sheet accumulation area 15 is adjusted.

During operation of the sheet conveyance apparatus, the front ends of the sheets S taken in from the upstream sheet processing apparatus by the conveyance roller pair 13 collide with the stopper plate 14 and thereby these sheets S are sequentially accumulated in the sheet accumulation area 15. On the other hand, the lowermost sheet of the accumulated sheets is separated from the remaining sheets S by the suction box 11 one by one, conveyed by the endless conveyer belts 3 toward the downstream end w of the conveyer surface 3*b* through the spacing between the conveyer surface 3*b* and the stopper plate 14, and supplied to the downstream sheet processing apparatus by the conveyance roller pair 16.

In such a way, even when the processing speed of the upstream sheet processing apparatus is higher than the processing speed of the downstream sheet processing apparatus, the sheet conveyance apparatus can temporarily accumulate the sheets S, which have been sequentially discharged from the upstream sheet processing apparatus, in the sheet accumulation area 15 and supply the lowermost sheet S out of the accumulated sheets S from the sheet accumulation area 15 to the downstream sheet processing apparatus one by one at timings synchronized with the processing speed of the downstream sheet processing apparatus. Thus, the sheet conveyance apparatus can facilitate smooth handover of the sheet S between the upstream and downstream sheet processing apparatuses.

In addition, even when the length of the sheet S to be processed in the upstream and downstream sheet processing apparatuses has been changed, it is possible to address a change in the sheet size easily and smoothly by changing the position of the carriage 8, that is, of the suction box 11 and the stopper plate 14 in accordance with the length of the sheet S to adjust the length of the sheet accumulation area 15.

In this embodiment, a mechanism to prevent contact between the accumulated lowermost sheet S and the conveyer surfaces 3*b* of the endless conveyer belts 3 is further provided in a region upstream of the upstream end 11*c* of the suction box 11 in the sheet accumulation area 15.

The mechanism to prevent contact has five third pulleys (roller elements) 5 provided coaxially with the second pulleys 2*b* between adjacent second pulleys 2*b* of the idle roller 2 and outside the outermost second pulleys 2*b* and made rotatable about the shaft 2*a*.

Further, each third pulley 5 has a larger diameter than the second pulley 2*b*.

The mechanism to prevent contact further has a cover sheet 17 that covers a region upstream of the suction box 11 in the sheet accumulation area 15.

The cover sheet 17 has a width corresponding to the width of the sheet accumulation area 15 and a length that is equal to or larger than the length from the upstream end 11*c* of the suction box 11 to the upstream end u of the sheet accumulation area 15 when the length of the sheet accumulation area 15 is the largest.

The mechanism to prevent contact further has two winding-type constant force plate springs 18 arranged at a fixed position under the downstream end of the endless conveyer belts 3.

Further, the one end 17*a* of the cover sheet 17 is fixed to the upstream end of the suction box 11 and extends across the sheet accumulation area 15, and the other end 17*b* of the cover sheet 17 extends to the winding-type constant force plate springs 18 via a part of the circumferential surface of the third pulleys 5 of the idle roller 2 and is attached to the end of each winding-type constant force plate spring 18.

The cover sheet 17 is continually subjected to tension by the winding-type constant force plate springs 18 and continually tensed in a state of being spaced apart from the endless conveyer belts 3 even when the length of the sheet accumulation area 15 is changed. Further, even when the endless conveyer belts 3 are rotated, the cover sheet 17 is stationary in a tense state.

In such a way, the region upstream of the suction box 11 in the sheet accumulation area 15 in the conveyer surfaces 3*b* of the endless conveyer belts 3 is continually covered with the cover sheet 17. Thus, while the lowermost sheet S accumulated in the sheet accumulation area 15 is separated from the remaining sheets S by the suction box 11 and fed out to the downstream from the sheet accumulation area 15 by the endless conveyer belts 3, it is prevented that the sheet S (standing by for being subsequently fed out) right above the sheet S being conveyed comes into contact with the endless conveyer belts 3 and is erroneously conveyed.

It is thus possible to reliably prevent occurrence of a conveyance error such as multi-feed or follow-feed of the sheet S to the downstream from the sheet accumulation area 15.

Note that, although the other end 17*b* of the cover sheet 17 is pulled by the winding-type constant force plate springs 18 in this embodiment, any tensioner that can continually apply tension in the longitudinal direction of the cover sheet 17 can be used instead of the winding-type constant force plate springs 18.

Further, although the cover sheet 17 is arranged such that the other end 17*b* turns back along the circumferential surface of the third pulley 5 of the idle roller 2 and then extends along the lower side of the endless conveyer belts 3 in this embodiment, the arrangement of the cover sheet 17 is not limited to this embodiment and may be arrangement such that the other end 17*b* extends beyond the upstream end u parallel to the conveyer surface 3*b*, for example.

The mechanism to prevent contact is provided as needed.

Figure 3:
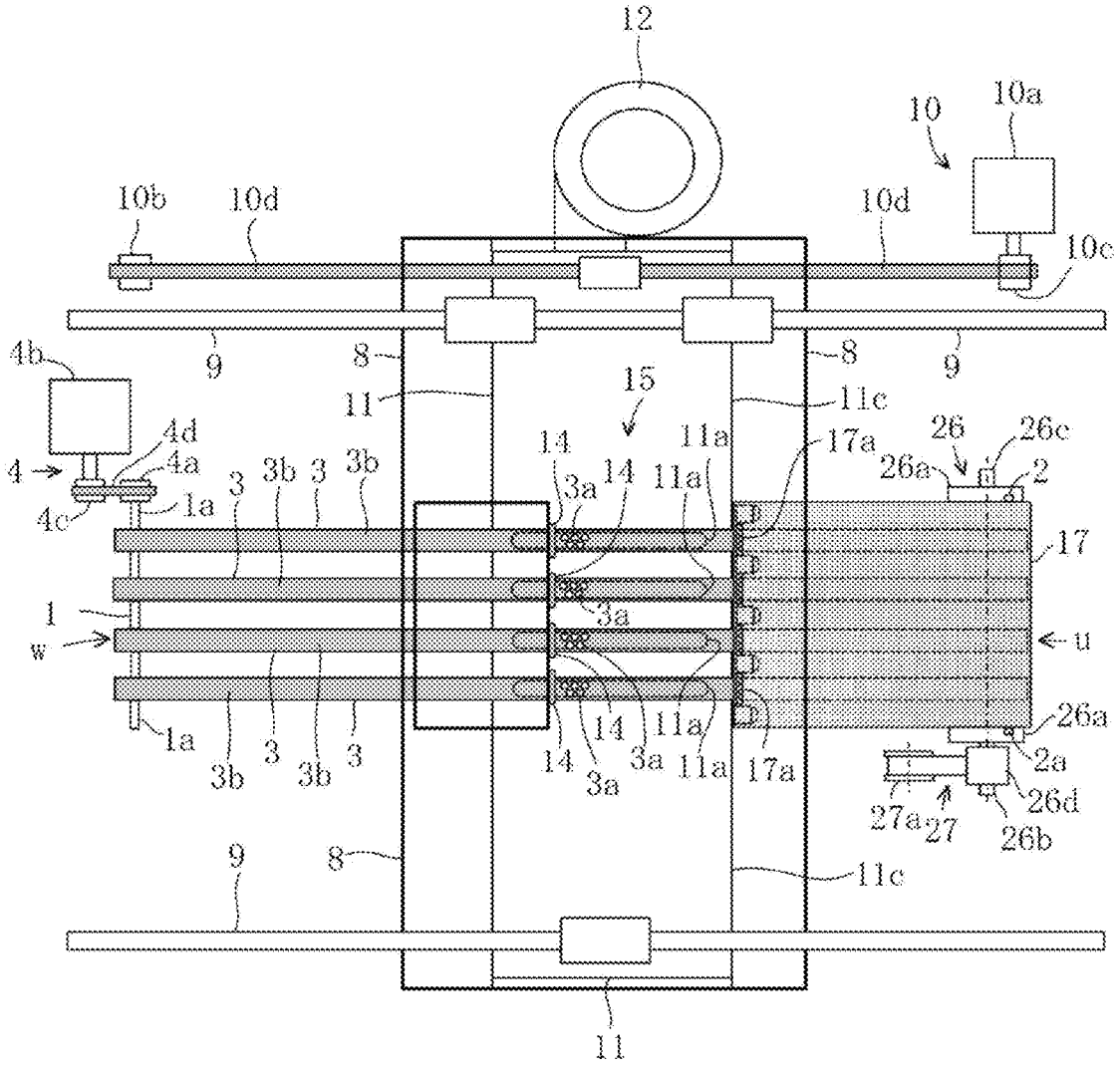
FIG. 3 is a schematic plan view of a sheet conveyance apparatus according to another embodiment of the present invention.

FIG. 3 is a schematic plan view of a sheet conveyance apparatus according to another embodiment of the present invention, FIG. 4(A) is a front view of the sheet conveyance apparatus of FIG. 3, and FIG. 4(B) is a plan view of a tensioner of the sheet conveyance apparatus of FIG. 4(A) when viewed in the X direction.

The embodiment of FIG. 3 and FIG. 4 differs from the embodiment illustrated in FIG. 1 and FIG. 2 only in the configuration of the tensioner of the mechanism to prevent contact.

Thus, in FIG. 3 and FIG. 4, the same components as those in FIG. 1 and FIG. 2 are labeled with the same numerals, and the detailed description thereof will be omitted below.

In the embodiment of FIG. 3 and FIG. 4, the tensioner has a cover sheet winding roller 26 arranged under and parallel to a roller that is one of the drive roller 1 and the idle roller 2 which has the third pulley 5 (in this embodiment, the idle roller 2).

The cover sheet winding roller 26 is formed of a body 26*a* and rotary shafts 26*b* and 26*c* projecting out of both ends of the body 26*a*, and a larger diameter portion 26*d* is provided to the rotary shaft 26*b* on one end side of the cover sheet winding roller 26.

Further, the one end 17*a* of the cover sheet 17 is fixed to the upstream end of the suction box 11 and extends across the sheet accumulation area 15. The other end 17*b* of the cover sheet 17 extends to the cover sheet winding roller 26 via a part of the circumferential surface of the third pulley 5 and is fixed to the circumferential surface of the cover sheet winding roller 26, and a certain length of the cover sheet 17 is wound on the cover sheet winding roller 26.

The tensioner has a winding-type constant force plate spring 27 arranged at a fixed position in the lower side of the endless conveyer belts 3, and the fixed position is on the opposite side from the third pulley 5 with respect to the cover sheet winding roller 26 and on one end side (the rotary shaft 26*b* side) of the cover sheet winding roller 26.

The winding-type constant force plate spring 27 is formed such that a winding part 27*a* is arranged so as to face the larger diameter portion 26*d* of the rotary shaft 26*b* and an end 27*b* is fixed to the circumferential surface of the larger diameter portion 26*d* to continually apply force to the cover sheet winding roller 26 in the winding direction of the cover sheet 17.

In such a way, the cover sheet 17 is continually subjected to tension by the tensioner (the cover sheet winding roller 26 and the winding-type constant force plate spring 27) and continually tensed in a state of being spaced apart from the endless conveyer belts 3 even when the length of the sheet accumulation area 15 is changed.

Accordingly, even when the endless conveyer belts 3 are rotated, the cover sheet 17 is stationary in a tense state.

Also in this embodiment, it is apparent that the same advantageous effect as that in the embodiment of FIG. 1 and FIG. 2 is obtained.

Figure 5A:
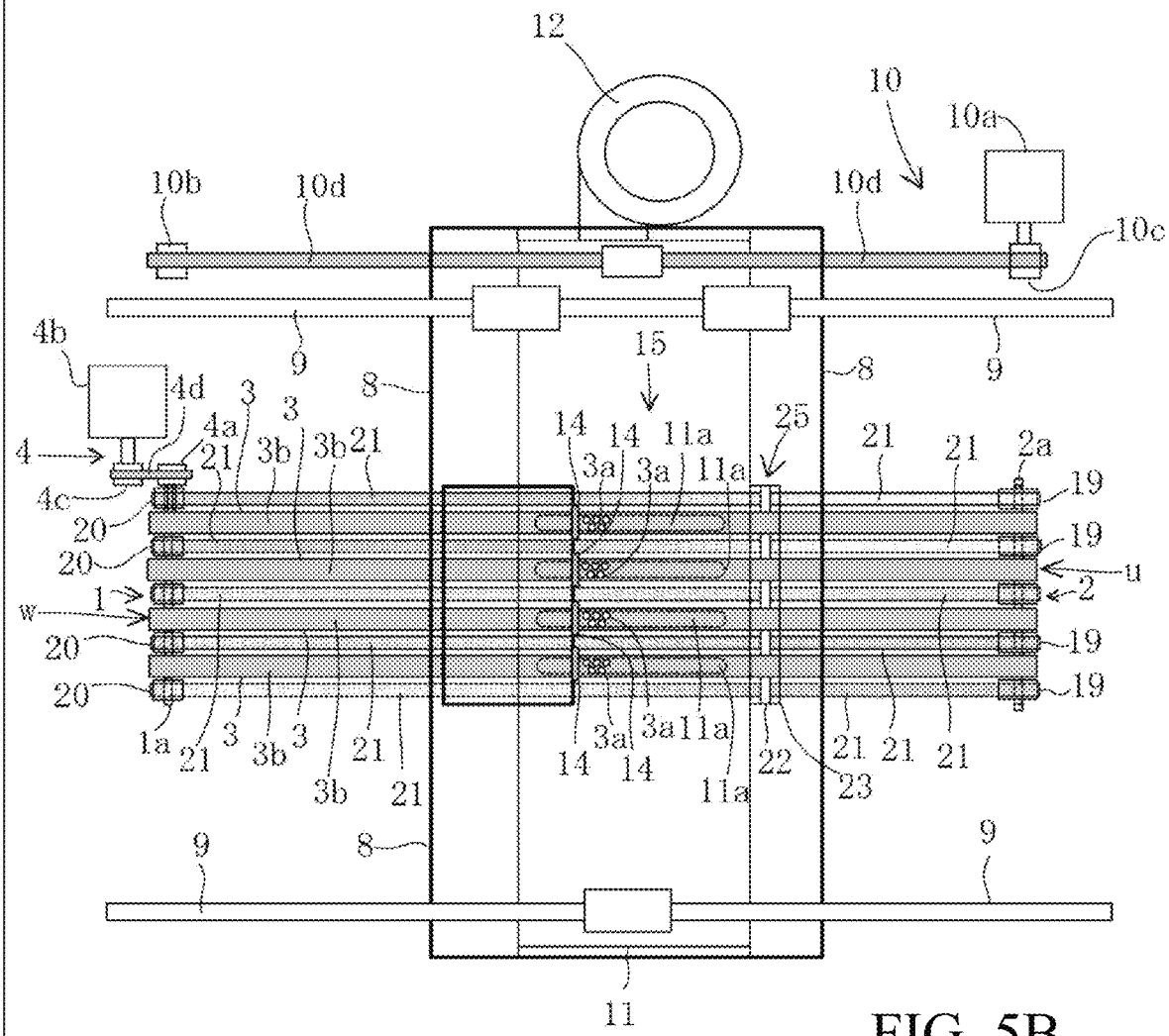
FIG. 5(A) is a plan view.
Figure 5B:
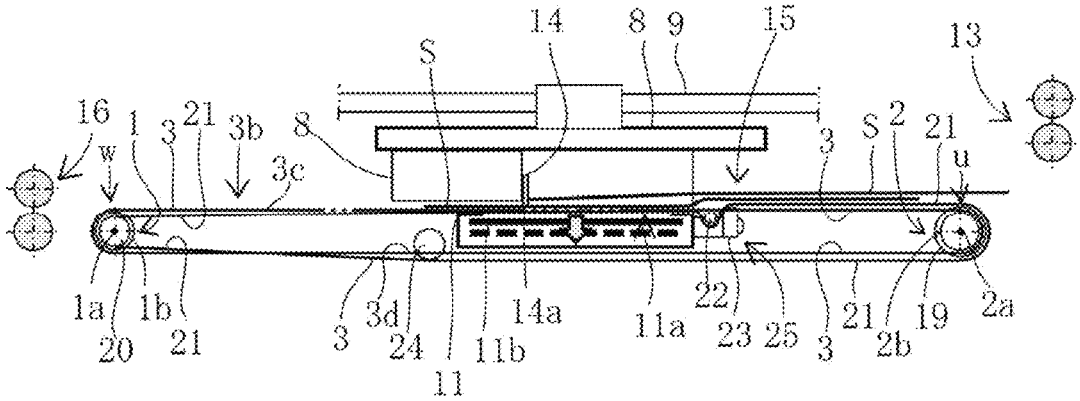
FIG. 5(B) is a front view.

FIG. 5 is a schematic diagram of a sheet conveyance apparatus according to another embodiment of the present invention, FIG. 5(A) is a plan view, and FIG. 5(B) is a front view.

The embodiment of FIG. 5 differs from the embodiment illustrated in FIG. 1 only in the configuration of the mechanism to prevent contact.

Thus, in FIG. 5, the same components as those in FIG. 1 are labeled with the same numerals, and the detailed description thereof will be omitted below.

In the embodiment of FIG. 5, the mechanism to prevent contact has third pulleys (roller elements) 19 provided coaxially with the second pulleys 2*b* between adjacent second pulleys 2*b* of the idle roller 2 and outside the outermost second pulleys 2*b* and made rotatable about the shaft 2*a*.

Further, each third pulley 19 has a larger diameter than the second pulley 2*b*.

The mechanism to prevent contact has fourth pulleys (roller elements) 20 provided coaxially with the first pulleys 1*b* between adjacent first pulleys 1*b* of the drive roller 1 and outside the outermost first pulleys 1*b* and made rotatable independently of the rotary shaft 1*a*.

Further, each fourth pulley 20 has a smaller diameter than the first pulley 1*b*.

The mechanism to prevent contact further has additional endless belts 21 extending parallel to the endless conveyer belt 3 stretched between the paired third and fourth pulleys 19 and 20. The upper surface 21*a* of the additional endless belt 21 has a lower friction factor than the conveyer surface 3*b* of the endless conveyer belt 3.

Furthermore, a guide 25 to guide the additional endless belts 21 is attached to the upstream end face of the suction box 11. The guide 25 has a horizontal guide roller 22 extending across the conveyer surfaces 3*b* at a position spaced apart from the upstream end face of the suction box 11 and a guide plate 23 extending parallel to the guide roller 22 on the opposite side from the suction box 11 with respect to the guide roller 22. The guide plate 23 has a cross section of an inverse L-shape with round corners.

The guide roller 22 has a vertex located at substantially the same height as the upper surface of the suction box 11, and the guide plate 23 has a top face located at substantially the same height as the vertex of the third pulleys 19 of the idle roller 2.

Further, the upper belt portion of each additional endless belt 21 extends to the guide plate 23 in the conveyance direction from the third pulley 19, extends downward along the guide plate 23, then extends toward the upper edge of the upstream end face of the suction box 11 along the under surface of the guide roller 22, and then extends to the fourth pulley 20 along the upper surface of the suction box 11.

Furthermore, a tension roller 24 extending across the additional endless belts 21 is arranged in the middle of the lower belt portions of the additional endless belts 21. The tension roller 24 continually maintains the additional endless belts 21 in a tense state even when the position of the carriage 8 (the stopper plate 24 and the suction box 11) is changed and the length of the sheet accumulation area 15 is thus changed.

In such a way, while the upper surface of each endless belt 21 is located at a higher position than the conveyer surface 3*b* of the endless conveyer belt 3 in a region upstream of the suction box 11 in the sheet accumulation area 15 but is located at a lower position than the conveyer surface 3*b* of the endless conveyer belt 3 in a region overlapping the suction box 11 in the sheet accumulation area 15 and a region downstream of the sheet accumulation area 15 on the conveyer surface 3*b*.

According to this embodiment, the additional endless belts 21 protrude out of the region upstream of the suction box 11 in the sheet accumulation area 15 on the conveyer surfaces 3*b* of the endless conveyer belts 3, and in this region, contact between the accumulated lowermost sheet S and the endless conveyer belts 3 is prevented.

Furthermore, the additional endless belts 21 are stationary even when the endless conveyer belts 3 are rotated.

Thus, while the lowermost sheet S accumulated in the sheet accumulation area 15 is separated from the remaining sheets S by the suction box 11 and fed out to the downstream from the sheet accumulation area 15 by the endless conveyer belts 3, it is prevented that the sheet S (standing by for being subsequently fed out) right above the sheet S being conveyed comes into contact with the endless conveyer belts 3 and is erroneously conveyed.

Although the preferred embodiments of the present invention have been described above, the configuration of the present invention is not limited to the embodiments described above, and it is apparent that those skilled in the art may devise various modified examples within the scope of the configuration described in the appended claims.

REFERENCE SIGNS LIST

1 drive roller
1*a* rotary shaft
1*b* first pulley (roller element)
2 idle roller
2*a* shaft
2*b* second pulley (roller element)
3 endless conveyer belt
3*a* airflow hole
3*b* conveyer surface
3*c* upper belt portion
3*d* lower belt portion
4 first drive mechanism
4*a* pulley
4*b* motor
4*c* pulley
4*d* endless belt
5 third pulley (roller element)
8 carriage
9 slide guide
10 second drive mechanism
10*a* motor
10*b* pulley
10*c* pulley
10*d* endless belt
11 suction box
11*a* intake hole
11*b* shutter
11*c* upstream end
12 suction fan (intake source)
13 conveyance roller pair
14 stopper plate
14*a* lower end
15 sheet accumulation area
16 conveyance roller pair
17 cover sheet
17*a* one end
17*b* the other end
18 winding-type constant force plate spring
19 third pulley (roller element)
20 fourth pulley (roller element)
21 additional endless belt
21*a* upper surface
22 guide roller
23 guide plate
24 tension roller
25 guide
26 cover sheet winding roller
26*a* body
26*b*, 26*c* rotary shaft
26*d* larger diameter portion
27 winding-type constant force plate spring
27*a* winding part
27*b* end
S sheet
u upstream end of conveyer surfaces
w downstream end of conveyer surfaces

The invention claimed is:

1. A sheet conveyance apparatus comprising:

a drive roller and an idle roller extending both horizontally and parallel to each other;

at least one endless conveyer belt stretched between the drive roller and the idle roller;

a first drive mechanism configured to rotate the drive roller;

a carriage arranged so as to reciprocate in a longitudinal direction of the endless conveyer belt above the at least one endless conveyer belt;

at least one slide guide extending in the longitudinal direction of the endless conveyer belt, the carriage being slidably attached to the at least one slide guide;

a second drive mechanism being configured to slide the carriage;

a suction box arranged so as to reciprocate in the longitudinal direction of the endless conveyer belt between upper and lower belt portions of the at least one endless conveyer belt; and an intake source configured to generate a negative pressure inside the suction box, wherein the suction box is attached to the carriage and has at least one intake hole in a surface facing the upper belt portion, wherein a plurality of airflow holes are provided in the longitudinal direction of the at least one endless conveyer belt at positions of the at least one endless conveyer belt that pass by the at least one intake hole during rotation of the at least one endless conveyer belt, and the sheet conveyance apparatus further comprising:

at least one conveyance roller pair extending above an upstream end of a conveyer surface of the at least one endless conveyer belt and across the conveyer surface and configured to take in a sheet and feed out the sheet onto the conveyer surface; and a stopper plate attached to the carriage and extending across the conveyer surface and upward from the conveyer surface, wherein a lower end of the stopper plate faces the suction box and is arranged with a predetermined spacing from the conveyer surface, and a region in the conveyer surface from the stopper plate to the upstream end of the conveyer surface forms a sheet accumulation area, and wherein sheets fed out from the at least one conveyance roller pair are sequentially accumulated in the sheet accumulation area when each front end of the sheets collides with the stopper plate, and the lowermost sheet of accumulated sheets is separated one by one from remaining sheets by the suction box and conveyed toward a downstream end of the conveyer surface through the spacing between the conveyer surface and the stopper plate by the at least one endless conveyer belt.

2. The sheet conveyance apparatus according to claim 1, further comprising:

a mechanism to prevent contact between the accumulated lowermost sheet and the conveyer surface of the at least one endless conveyer belt in a region upstream of the upstream end of the suction box in the sheet accumulation area.

3. The sheet conveyance apparatus according to claim 2, the mechanism to prevent contact has a cover sheet that covers a region upstream of the suction box in the sheet accumulation area, wherein the cover sheet has a width corresponding to a width of the sheet accumulation area and a length equal to or larger than a length from the upstream end of the suction box to an upstream end of the sheet accumulation area when a length of the sheet accumulation area is the largest, and one end of the cover sheet is fixed to the upstream end of the suction box and extends across the sheet accumulation area, and wherein the mechanism to prevent contact further has a tensioner attached to the other end of the cover sheet and configured to continually apply tension in a longitudinal direction of the cover sheet, and the cover sheet is tensed in a state where a portion of the cover sheet covering the at least one endless conveyer belt is continually spaced apart from the at least one endless conveyer belt.

4. The sheet conveyance apparatus according to claim 3, wherein the at least one endless conveyer belt includes a plurality of endless conveyer belts spaced apart from each other in the width direction, wherein the drive roller has a horizontal rotary shaft, and a plurality of first roller elements axially spaced apart from each other and attached to the rotary shaft integrally with and rotatably about the rotary shaft, wherein the idle roller has a plurality of second roller elements arranged so as to be rotatable about a parallel shaft parallel to the rotary shaft of the drive roller and face the plurality of first roller elements, respectively, and each of the plurality of endless conveyer belts is stretched between the first and second roller elements paired with each other, and the rotary shaft of the drive roller is rotated by the first drive mechanism, wherein the mechanism to prevent contact further has, between the first roller elements adjacent to each other or the second roller elements adjacent to each other of a roller that is one of the drive roller and the idle roller which is located at the upstream end of the conveyer surface and outside the outermost one of the first or second roller elements, a plurality of third roller elements each provided coaxially with the first or second roller elements and rotatably independently of the rotary shaft or rotatably about the parallel shaft, and each of the third roller elements has a larger diameter than each of the first or second roller elements of interest, and wherein the tensioner includes at least one winding-type constant force plate spring arranged at a fixed position under the at least one endless conveyer belt, and the other end of the cover sheet extends to the at least one winding-type constant force plate spring via a part of circumferential surfaces of the third roller elements and is attached to an end of the at least one winding-type constant force plate spring.

5. The sheet conveyance apparatus according to claim 3, wherein the at least one endless conveyer belt includes a plurality of endless conveyer belts spaced apart from each other in the width direction, wherein the drive roller has a horizontal rotary shaft, and a plurality of first roller elements axially spaced apart from each other and attached to the rotary shaft integrally with and rotatably about the rotary shaft, wherein the idle roller has a plurality of second roller elements arranged so as to be rotatable about a parallel shaft parallel to the rotary shaft of the drive roller and face the plurality of first roller elements, respectively, and each of the plurality of endless conveyer belts is stretched between the first and second roller elements paired with each other, and the rotary shaft of the drive roller is rotated by the first drive mechanism, wherein the mechanism to prevent contact further has, between the first roller elements adjacent to each other or the second roller elements adjacent to each other of a roller that is one of the drive roller and the idle roller which is located at the upstream end of the conveyer surface and outside the outermost one of the first or second roller elements, a plurality of third roller elements each provided coaxially with the first or second roller elements and rotatably independently of the rotary shaft or rotatably about the parallel shaft, and each of the third roller elements has a larger diameter than each of the first or second roller elements of interest, wherein the tensioner has a cover sheet winding roller arranged under and parallel to a roller that is one of the drive roller and the idle roller which has the third roller elements, and the other end of the cover sheet extends to the cover sheet winding roller via a part of circumferential surfaces of the third roller elements and is fixed to a circumferential surface of the cover sheet winding roller, and wherein the tensioner further has at least one winding-type constant force plate spring arranged at a fixed position under the at least one endless conveyer belt, the fixed position is on the opposite side from the third roller elements with respect to the cover sheet winding roller and on at least one end side of the cover sheet winding roller, an end of the winding-type constant force plate spring is attached to a rotary shaft of the cover sheet winding roller, and the winding-type constant force plate spring continually applies force to the cover sheet winding roller in a winding direction of the cover sheet.

6. The sheet conveyance apparatus according to claim 2, wherein the at least one endless conveyer belt includes a plurality of endless conveyer belts spaced apart from each other in the width direction, wherein the drive roller has a horizontal rotary shaft, and a plurality of first roller elements axially spaced apart from each other and attached to the rotary shaft integrally with and rotatably about the rotary shaft, wherein the idle roller has a plurality of second roller elements arranged so as to be rotatable about a parallel shaft parallel to the rotary shaft and face the plurality of first roller elements, and each of the plurality of endless conveyer belts is stretched between the first and second roller elements paired with each other, and the rotary shaft of the drive roller is rotated by the first drive mechanism, wherein the mechanism to prevent contact has, between the first roller elements adjacent to each other or the second roller elements adjacent to each other of a roller that is one of the drive roller and the idle roller which is located at the upstream end of the conveyer surface and outside the outermost one of the first or second roller elements, a plurality of third roller elements each provided coaxially with the first or second roller elements and rotatably independently of the rotary shaft or rotatably about the parallel shaft, and each of the third roller elements has a larger diameter than each of the first or second roller elements of interest, wherein the mechanism to prevent contact further has, between the first roller elements adjacent to each other or the second roller elements adjacent to each other of a roller that is one of the drive roller and the idle roller which is located at the downstream end of the conveyer surface and outside the outermost one of the first or second roller elements, a plurality of fourth roller elements each provided coaxially with the first or second roller elements and rotatably independently of the rotary shaft or rotatably about the parallel shaft, and each of the fourth roller elements has a smaller diameter than each of the first or second roller elements of interest, and wherein the mechanism to prevent contact further has an additional endless belt stretched between the third and fourth roller elements paired with each other and extending parallel to the plurality of endless conveyer belts, and an upper surface of the additional endless belt has a smaller friction factor than respective conveyer surfaces of the plurality of endless conveyer belts, and the upper surface of the additional endless belt is at a higher position than the conveyer surfaces of the plurality of endless conveyer belts in a region upstream of the suction box in the sheet accumulation area and is at a lower position than the conveyer surfaces of the plurality of endless conveyer belts in a region overlapping the suction box in the sheet accumulation area and a region downstream of the sheet accumulation area on the conveyer surfaces.

* * * * *